US007270585B2

(12) United States Patent
Yamauchi et al.

(10) Patent No.: US 7,270,585 B2
(45) Date of Patent: Sep. 18, 2007

(54) PLASMA DISPLAY PANEL AND ITS AGING METHOD

(75) Inventors: Masaaki Yamauchi, Osaka (JP); Takashi Aoki, Osaka (JP); Akihiro Matsuda, Osaka (JP); Koji Akiyama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/510,977

(22) PCT Filed: Feb. 18, 2004

(86) PCT No.: PCT/JP2004/001762

§ 371 (c)(1),
(2), (4) Date: Oct. 13, 2004

(87) PCT Pub. No.: WO2004/075236

PCT Pub. Date: Sep. 2, 2004

(65) Prior Publication Data

US 2005/0162085 A1 Jul. 28, 2005

(30) Foreign Application Priority Data

Feb. 19, 2003 (JP) ..... 2003-041126

(51) Int. Cl.
*H01J 9/00* (2006.01)

(52) U.S. Cl. ..... 445/6; 445/62

(58) Field of Classification Search ..... 315/169.4; 313/581, 621, 622, 631, 306; 445/6, 24, 445/62, 67; 345/204, 698, 60
See application file for complete search history.

(56) References Cited

U.S. PATENT DOCUMENTS

| | | | | |
|---|---|---|---|---|
| 6,037,916 | A * | 3/2000 | Amemiya | 345/60 |
| 6,144,163 | A * | 11/2000 | Amemiya et al. | 315/169.1 |
| 6,337,673 | B1 * | 1/2002 | Ide et al. | 345/60 |
| 6,373,195 | B1 * | 4/2002 | Whang et al. | 315/169.3 |
| 6,630,796 | B2 * | 10/2003 | Tokunaga et al. | 315/169.4 |
| 6,666,738 | B1 * | 12/2003 | Kado et al. | 445/6 |
| 6,761,605 | B2 * | 7/2004 | Kado et al. | 445/6 |
| 6,975,286 | B2 * | 12/2005 | Rhee | 345/60 |

FOREIGN PATENT DOCUMENTS

JP 2000-231883 8/2000

(Continued)

*Primary Examiner*—Thuy Vinh Tran
(74) *Attorney, Agent, or Firm*—Wenderoth, Lind & Ponack, L.L.P.

(57) ABSTRACT

In an aging process in which a voltage having an alternate voltage component is applied to at least between a scan electrode and a sustain electrode so as to form a discharge dent (sputter dent) on a protecting layer, the aging discharge dent is formed so as to satisfy any one of the following. First, the discharge dent on the scan electrode-side has a width which is narrower than the discharge dent on the side of sustain electrode. Second, the discharge dent on the side of sustain electrode is formed so that the depth of the discharge dent in the area away from a scan electrode paired with a sustain electrode as a display electrode is shallower than the depth of the discharge dent in the area close to counterpart scan electrode.

5 Claims, 4 Drawing Sheets

FOREIGN PATENT DOCUMENTS

| | | |
|---|---|---|
| JP | 2001-357787 | 12/2001 |
| JP | 2002-75208 | 3/2002 |
| JP | 2002-352722 | 12/2002 |
| JP | 2002-352730 | 12/2002 |
| JP | 2002-358891 | 12/2002 |
| JP | 2002-373588 | 12/2002 |
| JP | 2003-308781 | 10/2003 |
| JP | 2003-317625 | 11/2003 |

* cited by examiner (the diagonally shaded areas show the discharge dent by sputtering)

PLASMA DISPLAY PANEL AND ITS AGING METHOD

TECHNICAL FIELD

The present invention relates to an alternative current (AC) plasma display panel and a method of aging the same.

BACKGROUND ART

A plasma display panel (hereinafter referred to as a PDP or simply a panel) is a display device with an excellent visibility and a large screen, and has a low-profile and lightweight body. The difference in discharging divides PDPs into two types of the alternating current (AC) type and the direct current (DC) type. In terms of the structure of electrodes, the PDPs fall into the 3-electrode surface discharge type and the opposing discharge type. In recent years, the dominant PDP is the AC type 3-electrode surface discharge PDP by virtue of having higher resolution and easier fabrication.

Generally, the AC type 3-electrode surface discharge PDP contains a front substrate and a back substrate disposed opposite from each other, and a plurality of discharge cells therebetween. On a front glass plate of the front substrate, scan electrodes and sustain electrodes, as display electrodes, are arranged in parallel with each other, and a dielectric layer and a protecting layer are formed over the display electrodes to cover the display electrodes. On the other hand, on a back glass plate of the back substrate, data electrodes are disposed in a parallel arrangement, and a dielectric layer is formed over the data electrodes to cover the data electrodes. On the dielectric layer between the data electrodes, a plurality of barrier ribs are formed in parallel with the rows of the data electrodes. Furthermore, a phosphor layer is formed between the barrier ribs and on the surface of the dielectric layer covering the data electrodes. The front substrate and the rear substrate are sealed with each other so that the display electrodes are orthogonal to the data electrodes in the narrow space between the two substrates. The narrow space, i.e., a discharge space, is filled with a discharge gas. The panel is thus fabricated.

Such a panel fabricated in this manner, however, generally exhibits a high voltage at the start of discharging, and the discharge itself is in an unstable condition. The panel is therefore aged in the manufacturing process to obtain consistent and stable discharge characteristics.

A conventional method has been employed for aging panels in which an anti-phased rectangular wave, that is, a voltage having an alternate (i.e., alternating) voltage component, is applied to a display electrode, i.e., between a scan electrode and a sustain electrode for a long period of time. To shorten the aging time, some methods have been suggested. For example, Japanese Patent Non-Examined Publication No. H07-226162 introduces a method in which a rectangular wave is applied, via an inductor, to the electrodes of a panel. On the other hand, Japanese Patent Non-Examined Publication No. 2002-231141 suggests a method as a combination of two kinds of discharging. According to the method, a pulse voltage having different polarity is placed between a scan electrode and a sustain electrode (i.e., discharging in the same surface) and consecutively, a pulse voltage having different polarity is now placed between the display electrodes and the data electrodes (i.e., discharging between the opposite surfaces).

Performing an aging process, as is known in the art, thins the surface of the protecting layer due to sputtering. However, an excessively strong aging provides the surface of the protecting layer with an excessive sputtering, thereby shortening the panel life.

The present invention addresses the problem described above. It is therefore an object of the invention to provide a long-life panel with minimized aging and an efficient aging method.

SUMMARY OF THE INVENTION

To achieve the object above, the present invention provides the following features. The aging process is performed on a plasma display panel having a plurality of pairs of a scan electrode and a sustain electrode as display electrodes, a dielectric layer covering the display electrodes, and a protecting layer disposed over the dielectric layer. In the aging process, an aging discharge is performed by applying voltage having an alternate (i.e., alternating) voltage component at least between the scan electrode and the sustain electrode in order to form a discharge dent on the protecting layer. According to the present invention, the aging discharge dent is formed so as to satisfy any one of the following. First, the discharge dent on the scan electrode-side has a width which is narrower than the discharge dent on the sustain electrode-side. Secondly, the discharge dent on the sustain electrode-side is formed so that the depth of the discharge dent in the area away from the scan electrode paired with the sustain electrode, as a display electrode, is shallower than the depth of the discharge dent in the area close to the counterpart scan electrode.

DETAILED DESCRIPTION OF THE INVENTION

The exemplary embodiments of the present invention are described hereinafter with reference to the accompanying drawings.

Exemplary Embodiment

Figure 1:
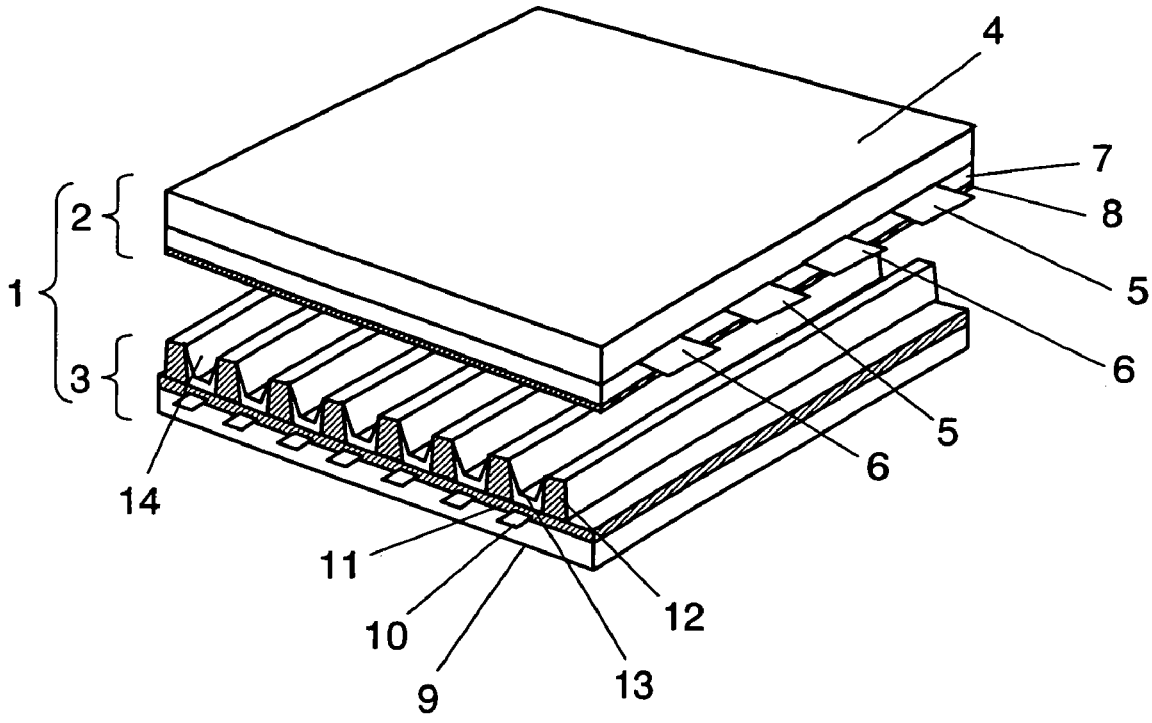
FIG. 1 is an exploded perspective view illustrating the structure of a panel according to an exemplary embodiment of the present invention.

FIG. 1 is an exploded perspective view illustrating the structure of a panel according to an exemplary embodiment of the present invention. Panel 1 contains a front substrate 2 and a back substrate 3 in a confronting arrangement. On a front glass plate 4 of the front substrate 2, a plurality of pairs of scan electrodes 5 and sustain electrodes 6 are arranged in parallel. The array of scan electrodes 5 and sustain electrodes 6 are covered with a dielectric layer 7, and a protecting layer 8 is formed over the dielectric layer 7 to cover the dielectric layer 7. On the other hand, on a back glass plate 9 of the back substrate 3, a plurality of data electrodes 10 are disposed in a parallel arrangement, and a dielectric layer 11 is formed over the data electrodes 10 to cover the data electrodes 10. On the dielectric layer 11, a plurality of barrier ribs 12 are formed in parallel with the rows of data electrodes 10. Furthermore, a phosphor layer 13 is formed between the barrier ribs 12 and on the surface of dielectric layer 11. Discharge spaces 14 formed between the front substrate 2 and the back substrate 3 are filled with a discharge gas.

Figure 2:
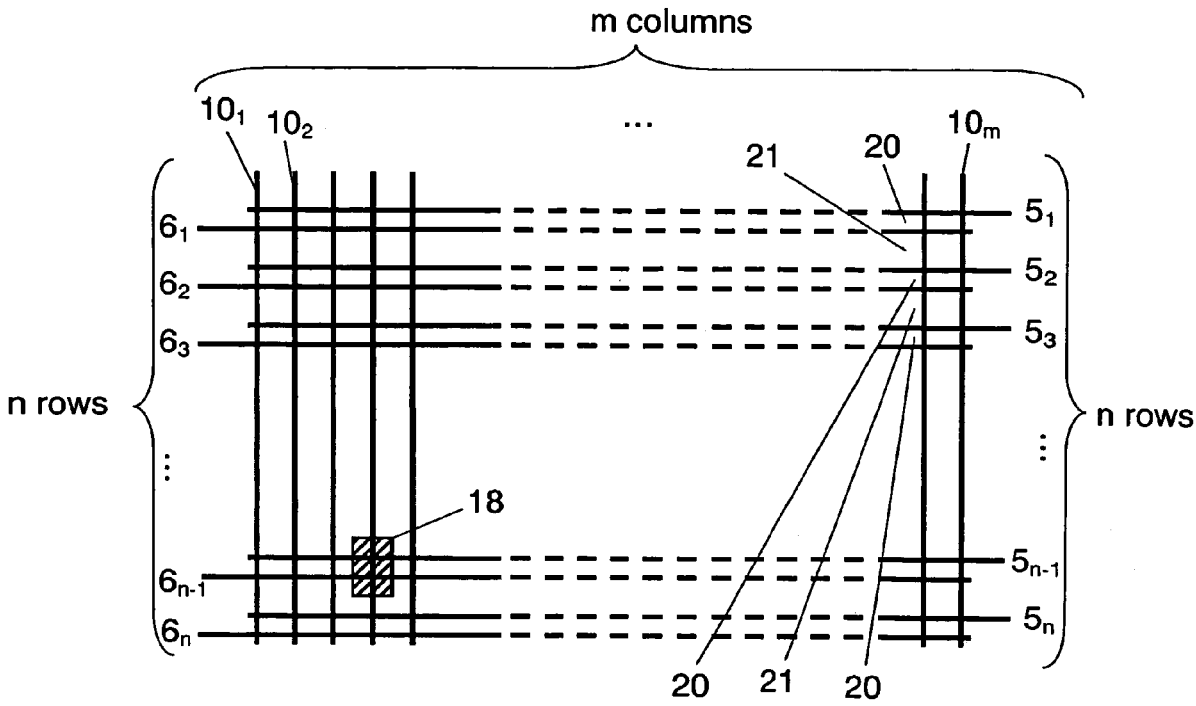
FIG. 2 shows the arrangement of the electrodes of the panel of the embodiment.

FIG. 2 shows the arrangement of electrodes of the panel 1 of the embodiment. m data electrodes $\mathbf{10}_1$-$\mathbf{10}_m$ (corresponding to data electrodes 10 shown in FIG. 1) are arranged in a direction of columns in FIG. 2. On the other hand, in a direction of rows in FIG. 2, n scan electrodes $\mathbf{5}_1$-$\mathbf{5}_n$ (scan electrodes 5 of FIG. 1) and n sustain electrodes $\mathbf{6}_1$-$\mathbf{6}_n$ (sustain electrodes 6 of FIG. 1) are alternately disposed. The array of the electrodes above forms m×n discharge cells 18 in the discharge space. Each of the discharge cells 18 contains a pair of a scan electrode $\mathbf{5}_i$ and a sustain electrode $\mathbf{6}_i$ (i takes the value 1 to n), and one data electrode $\mathbf{10}_j$ (j takes the value 1 to m). Each scan electrode $\mathbf{5}_i$ is connected to a corresponding electrode terminal section $\mathbf{15}_i$ disposed around the perimeter of the panel 1. Similarly, each sustain electrode $\mathbf{6}_i$ is connected to a corresponding sustain electrode terminal section, and each data electrode $\mathbf{10}_j$ is connected to a corresponding data electrode terminal section. Here, the gap formed between the scan electrode 5 and the sustain electrode 6 for each of the discharge cells 18 is referred to as discharge gap 20, and the gap formed between the discharge cells, i.e., between scan electrode $\mathbf{5}_i$ and sustain electrode $\mathbf{6}_{i-1}$ that belongs to the next (adjacent) discharge cell is referred to as an adjacent gap 21.

Figure 3A:
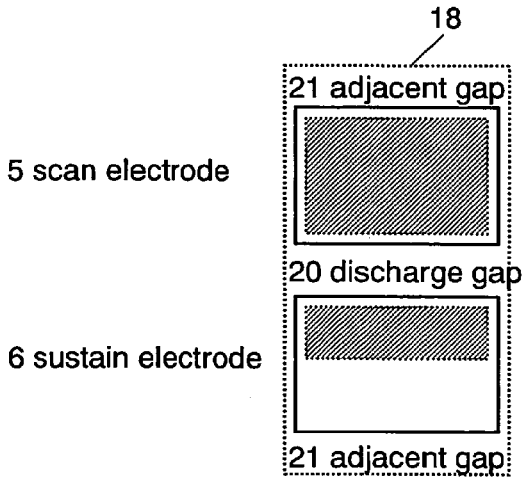
FIG. 3A schematically shows the discharge dent formed on the panel after the aging process.

After completion of the aging process, the inventors disassembled a panel and observed a discharge dent (i.e., the dent formed by sputtering in the aging process). FIG. 3A schematically shows the discharge dent (the diagonally shaded areas) on the surface of the protecting layer 8. As shown in FIG. 3A, on the side of the scan electrode 5, the discharge dent covers almost all over the width of the scan electrode 5, whereas on the side of the sustain electrode 6, the discharge dent is localized in the area close to the counterpart scan electrode 5 as a display electrode, that is, in the area on the side of the discharge gap 20. That is, the discharge dent formed on the side of the sustain electrode 6 is narrower in width than that formed on the side of the scan electrode 5.

The aging process provides, as described above, the surface of the protecting layer 8 with sputtering. However, the sputtering amount is very small, and the discharge dent by the aging process rarely can be found under an ordinary optical microscope. The observation of the discharge dent is done by a scanning electron microscope (SEM), which is highly sensitive to the shape of matter surface. A SEM scans on the surface of a sample and finds the image of secondary electrons which are emitted from the surface. The protecting layer is formed of an MgO film. The surface of the film just fabricated has microscopic asperities that are less than 100 nm. Through the aging process, the irregular surface is smoothed by sputtering. The amount of secondary electron emission is larger from an inclined or projected surface than a flat surface. In the image of the secondary electron observed under the SEM, the well-sputtered surface of the protecting layer looks dark, whereas the surface with no sputtering or insufficient sputtering looks bright. The discharge dent shown in FIG. 3 is observed by the SEM. Prior to observation by the SEM, it is important that the surface of protecting layer 8 should be coated—since it is insulating material—with a thin film of platinum or gold, in order to protect the surface from being charged up.

The following describes why the discharge dent is differently formed between the area on the side of scan electrode 5 and the area on the side of sustain electrode 6.

Figure 3B:
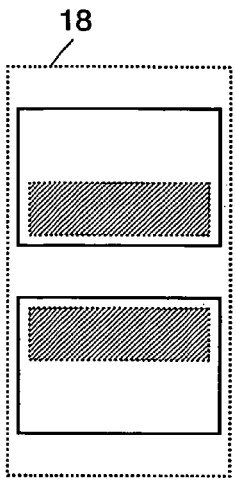
FIG. 3B schematically shows the discharge dent which is essential to lower and stabilize the voltage at the start of the sustaining discharge.

In a sequence of initial, writing, and sustaining discharge of the 3-electrode PDP in operation, the writing discharge and the sustaining discharge are under the influence of the operating voltage. FIG. 3B schematically shows the discharge dent which is essential to lower and stabilize the voltage at the start of the sustaining discharge. In the sustaining discharge, the discharge occurs by applying a rectangular voltage pulse between the scan electrode 5 and the sustain electrode 6. At this time, the discharge occurs in the areas close to the discharge gap 20 of the scan and sustain electrodes 5,6. The areas are required to have enough aging, i.e., the surfaces of the protecting layer in the areas have to be well sputtered; otherwise, the surfaces of the areas would undergo sputtering in the sustaining discharge in the panel operation, as well as in the aging process, and the shape of the surfaces is altered by the undesired sputtering. The change in shape of the surface invites variations in voltage of the sustaining discharge, resulting in poor display characteristics. To protect the panel from the above inconveniences, the aging process should be performed so as to focus on the area close to discharge gap 20 in the scan electrode 5 and the sustain electrode 6. Compared to the discharge dent of the area on the side of adjacent gap 21, the discharge dent of the area on the side of discharge gap 20 has to have an enough depth so as to minimize the change in shape of the surface of the protecting layer in the panel operations. In other words, for obtaining the stability of the sustaining discharge, the area on the side of adjacent gap 21 does not necessarily have a deep discharge dent by a strong aging.

Figure 3C:
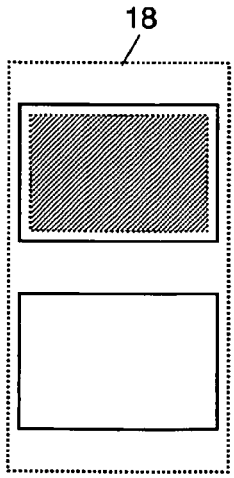
FIG. 3C schematically shows the discharge dent which is essential to lower and stabilize the voltage at the start of the writing discharge.

On the other hand, FIG. 3C schematically shows the discharge dent which is essential to lower and stabilize the voltage at the start of the writing discharge. The writing discharge occurs between the scan electrode 5 and the data electrode 10. To obtain stability of voltage in the writing discharge in panel operation, it is preferable that the entire area on the side of the scan electrode 5 facing the data electrode 10 undergoes aging so as to have uniform discharge dent by entire sputtering. That is, as far as the writing discharge is concerned, the aging on the side of the sustaining electrode 6, i.e., forming the discharge dent on that side does not have much importance.

Therefore, in order to stabilize both of the sustaining and writing discharges, the aging should preferably be performed on the area that covers both the diagonally shaded areas in FIGS. 3B and 3C, i.e., the area shown in FIG. 3A. Although the area on the side of the discharge gap 20 of the scan electrode 5 undergoes both the sustaining discharge and the writing discharge, this area does not need to have a discharge dent which is deeper than the area on the side of the adjacent gap 21 of an identical scan electrode 5. The aging should be uniformly performed on the entire area on the side of the scan electrode 5. On the contrary, an excessive aging on the area on the side of the discharge gap 20 not only shortens the life of a panel, but also increases unnecessary electric power.

Figure 3D:
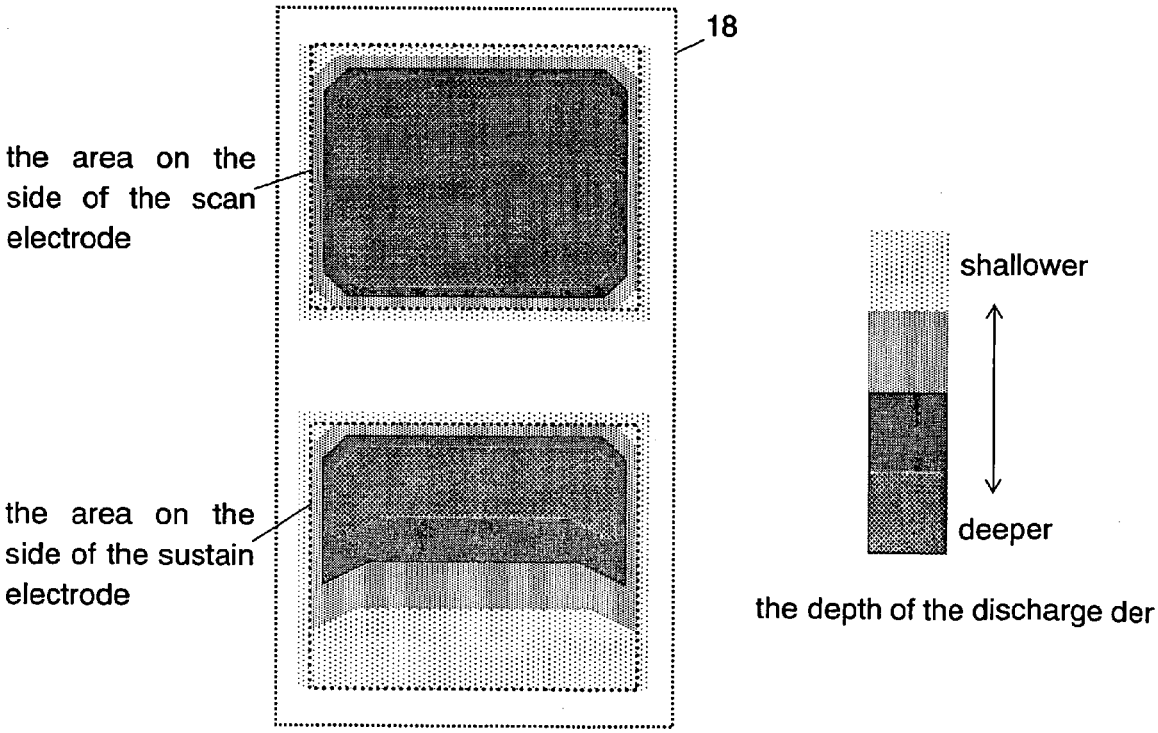
FIG. 3D schematically shows a depth distribution of the discharge dent formed on the panel of the embodiment.

FIG. 3D schematically shows a depth distribution of the discharge dent formed on the panel of the embodiment. According to the aging of the embodiment, the discharge dent is formed so as to have a distribution with continuous and gradual change shown in FIG. 3D, instead of a "two-valued" distribution shown in FIG. 3A. The discharge dent on the side of the sustain electrode 6 is formed so that the depth of the discharge dent in the area away from the scan electrode 5 paired with the sustain electrode 6 as the counterpart of a display electrode is shallower than the depth in the area close to the counterpart scan electrode 5.

As described above, performing a minimum amount of aging on a necessary area can minimize sputtering to the protecting layer 8, thereby increasing the life of the panel. An additional advantage is that the aging time can be shortened, with the efficiency of electric power increased.

Figure 4A:
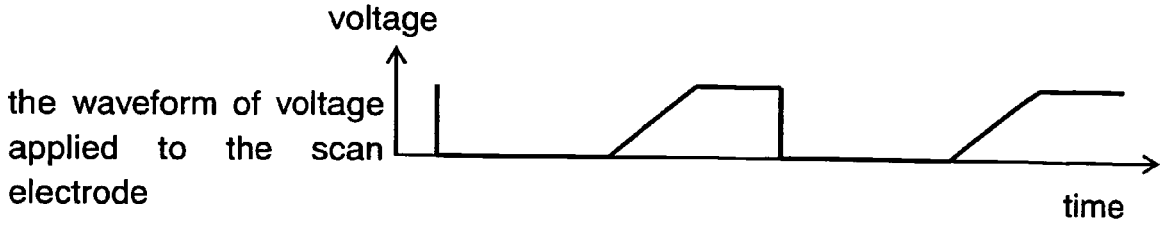
FIG. 4A shows an aging waveform to form an asymmetric discharge dent of the embodiment.
Figure 4B:
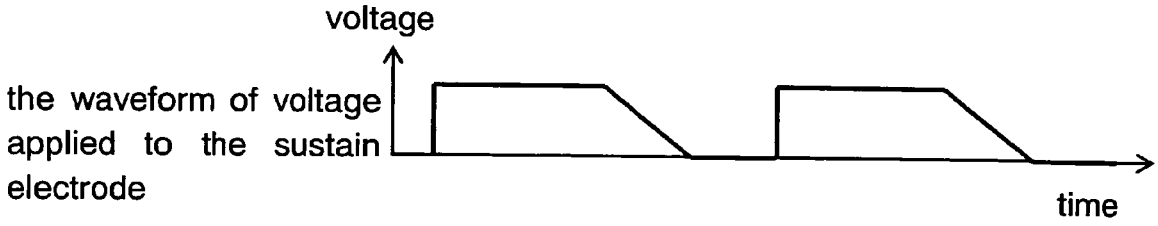
FIG. 4B shows another aging waveform to form an asymmetric discharge dent of the embodiment.

FIGS. 4A and 4B show examples of aging waveforms to form an asymmetric discharge dent of the embodiment. As shown in FIGS. 4A and 4B, a voltage having an alternate (i.e., alternating) voltage component is applied between the scan electrode 5 and the sustain electrode 6. The voltage applied to the scan electrode 5 exhibits, as shown in FIG. 4A, a leading edge having a mild slope and a precipitous trailing edge. In contrast, the voltage applied to the sustain electrode 6 has a precipitous leading edge and a mild trailing edge, as shown in FIG. 4B. Although the leading edge of the voltage waveform for the scan electrode 5 and the trailing edge of the waveform for the sustain electrode 6 have a mild slope in the embodiment, the present invention is not limited thereto; either one of them may exhibit a mild slope. The voltage waveform applied to the data electrode 10 is not shown in FIGS. 4A and 4B. Data electrode 10 may be placed with no voltage, or may be connected to a ground.

Figure 4C:
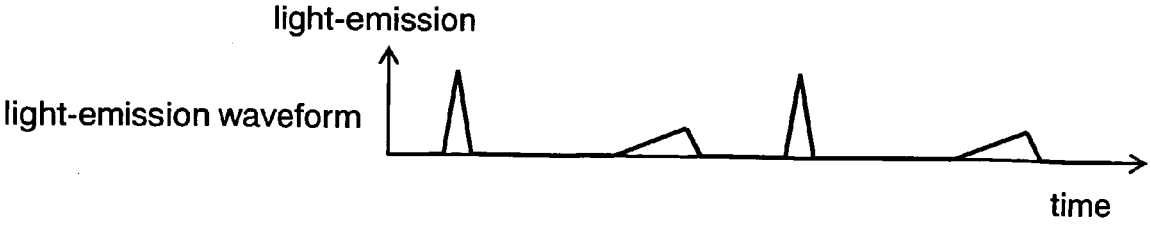
FIG. 4C schematically shows light emission of a panel in the form of a waveform detected by a photo sensor.

FIG. 4C schematically shows light emission of a panel in the form of a waveform detected by a photo sensor according to the embodiment. As is apparent from FIG. 4C, a strong discharge occurs in response to a steep change in voltage and a weak discharge occurs at a mild change in voltage. In the aging waveform, when the strong discharge occurs, positive ions attracted to the scan electrode 5 as the cathode cause a strong sputtering on the surface of the protecting layer 8. On the other hand, the sustain electrode 6 collects electrons; however, an electron has small mass. Therefore, a strong sputtering never occurs on the surface on the side of the sustain electrode 6. The weak discharge following the strong discharge is the discharge that is localized around the discharge gap 20. In the discharge, positive ions, which are attracted to the sustain electrode 6 close to the discharge gap 20, cause a strong sputtering on the surface of the protecting layer 8. The repeatedly caused sputtering is believed to be forming the discharge dent shown in FIG. 3A.

As described above, by generating a relatively strong discharge when the voltage waveform applied to scan electrode 5 has the trailing edge (i.e., when the scan electrode 5 acts as cathode); on the other hand, generating a relatively weak discharge when the voltage waveform applied to the sustain electrode 6 has the trailing edge (i.e., when the sustain electrode 6 acts as cathode), the discharge dent shown in FIG. 3 can be formed. However, an excessively strong discharge, which is brought by an application of increased voltage to the electrodes, is not desired in the aging process. Through such a too strong discharge, the depth of the discharge dent on the side of the adjacent gap 21 is inconveniently deeper than that of the discharge dent on the side of the discharge gap 20. According to the embodiment of the present invention, the optimum voltage is experimentally determined to be 210 V The optimum voltage highly depends on the electrode structure and the material of a panel; the voltage value should be optimized to each panel.

Prior to the actual panel operation, a panel has to undergo the aging process so as to operate with stability in the sustaining discharge and the writing discharge—two main discharges in an AC type 3-electrode PDP. According to the embodiment, a desired discharge dent, as shown in FIG. 3A, can be formed on the surface of the protecting layer 8 by performing a minimized aging. Conversely, designing the aging waveform and aging device so as to form the discharge dent of FIG. 3A allows a panel to have a long life.

The plasma display panel of the present invention has a long operating life by virtue of a minimized discharge dent.

INDUSTRIAL APPLICABILITY

The present invention introduces a panel having a minimal amount of discharge dent and an aging method of forming the minimized discharge dent on a panel. The method is effective in aging an AC type plasma display panel, and the panel processed by the method provides a long lasting quality.

The invention claimed is:

1. A method of aging a plasma display panel having a scan electrode covered with a dielectric layer, a sustain electrode covered with the dielectric layer and a data electrode, said method comprising:

during manufacture of the plasma display panel, performing an aging discharge by applying a voltage having an alternating voltage component at least between the scan electrode and the sustain electrode such that the voltage is applied in an alternating manner between one condition in which the scan electrode acts as an anode and the sustain electrode acts as a cathode, and another condition in which the scan electrode acts as a cathode and the sustain electrode acts as an anode;

wherein a waveform of voltage applied between the scan electrode and the sustain electrode, in the condition in which the scan electrode acts as the cathode and the sustain electrode acts as the anode, has a gradually ascending leading edge and a sharply descending trailing edge; and wherein a waveform of voltage applied between the scan electrode and the sustain electrode, in the condition in which the scan electrode acts as the anode and the sustain electrode acts as the cathode, has a sharply ascending leading edge and a gradually descending trailing edge.

2. A method of aging a plasma display panel, according to claim 1, wherein, in said performing of the aging discharge:

in the condition in which the scan electrode acts as the cathode and the sustain electrode acts as the anode, the gradually ascending leading edge of the waveform has an ascending slope smaller than a descending slope of the sharply descending trailing edge; and in the condition in which the scan electrode acts as the anode and the sustain electrode acts as the cathode, the sharply ascending leading edge of the waveform has an ascending slope greater than a descending slope of the gradually descending trailing edge.

3. A method of aging a plasma display panel, according to claim 1, wherein in said performing of the aging discharge, the aging discharge is carried out in such a manner as to form an asymmetric dent in a protecting layer covering the dielectric layer.

4. A method of aging a plasma display panel having a scan electrode covered with a dielectric layer, a sustain electrode covered with the dielectric layer and a data electrode, said method comprising:

during manufacture of the plasma display panel, performing an aging discharge by applying a voltage having an alternating voltage component at least between the scan electrode and the sustain electrode such that the voltage is applied in an alternating manner between one condition in which the scan electrode acts as an anode and the sustain electrode acts as a cathode, and another condition in which the scan electrode acts as a cathode and the sustain electrode acts as an anode;

wherein the aging discharge in the condition in which the scan electrode acts as the anode and the sustain electrode acts as the cathode is weaker than the aging discharge in the condition in which the scan electrode acts as the cathode and the sustain electrode acts as the anode.

5. A method of aging a plasma display panel, according to claim 4, wherein in said performing of the aging discharge, the aging discharge is carried out in such a manner as to form an asymmetric dent in a protecting layer covering the dielectric layer.

* * * * *